US006819061B2

(12) United States Patent
Danjo et al.

(10) Patent No.: US 6,819,061 B2
(45) Date of Patent: Nov. 16, 2004

(54) POWER SUPPLY APPARATUS FOR LIGHT SOURCE

(75) Inventors: Kenzo Danjo, Osaka (JP); Takashi Tsujii, Osaka (JP); Masataka Nishimura, Osaka (JP)

(73) Assignee: Sansha Electric Manufacturing Company, Limited, Osaka (JP)

( * ) Notice: Subject to any disclaimer, the term of this patent is extended or adjusted under 35 U.S.C. 154(b) by 0 days.

(21) Appl. No.: 10/323,196

(22) Filed: Dec. 18, 2002

(65) Prior Publication Data

US 2003/0173909 A1 Sep. 18, 2003

(30) Foreign Application Priority Data

Dec. 21, 2001 (JP) ..... 2001-390253

(51) Int. Cl.[7] ..... H05B 37/02
(52) U.S. Cl. ..... 315/291; 315/307; 315/308
(58) Field of Search ..... 315/291, 307, 315/308, 209 R, 119, DIG. 5, 219; 363/17, 56, 98, 34, 93, 37

(56) References Cited

U.S. PATENT DOCUMENTS 4,654,770 A * 3/1987 Santurtun et al. ..... 363/17
5,267,138 A * 11/1993 Shores ..... 363/98
5,712,771 A 1/1998 Fitter et al.
6,122,180 A 9/2000 Seo et al.
2002/0001209 A1 1/2002 Moriguchi et al.

FOREIGN PATENT DOCUMENTS

GB 1529824 A 10/1975

* cited by examiner

*Primary Examiner*—Tuyet Vo
*Assistant Examiner*—Chuc Tran
(74) *Attorney, Agent, or Firm*—Duane Morris LLP

(57) ABSTRACT

A power supply apparatus for a light source includes an input-side rectifier (32) which converts an input AC signal to a DC signal, and a high-frequency inverter (36) which converts the DC signal to a high-frequency signal. An output-side rectifier (42) converts the high-frequency signal to a DC output signal for application to the light source. Power detecting means (52) detects the power supplied to the light source through the application of the DC output signal thereto, and develops a power representative signal. A control circuit (38), a summer (54) and an error amplifier (58) cooperate to control the high-frequency inverter (36) in accordance with the power representative signal in such a manner that power of a predetermined value can be supplied to the light source. An input current detector (60) detects the input AC signal current value and develops an input current representative signal. When the input current representative signal is smaller than a predetermined input current reference value, a summer (62) and an error amplifier (66) cooperate to provide the summer (54) with such a control signal as to maintain the input AC signal current value at a predetermined value.

6 Claims, 4 Drawing Sheets

POWER SUPPLY APPARATUS FOR LIGHT SOURCE

This invention relates to a power supply apparatus for light sources, for example, a power supply apparatus for a lamp for use in a projector or a power supply apparatus for illuminating equipment.

BACKGROUND OF THE INVENTION

The arrangement of an example of prior art power supply apparatuses for light sources is as follows. The power supply apparatus includes an input-side rectifier which converts a commercial AC voltage applied thereto to a DC voltage. The DC voltage is then applied to a high-frequency inverter where it is converted to a high-frequency voltage. The high-frequency voltage is voltage-transformed by a transformer, and the voltage-transformed voltage is converted to a DC voltage by an output-side rectifier. This DC voltage is applied to a load, e.g. a lamp. Current supplied to the load is detected by a current detector, which develops a current representative voltage representative of the magnitude of the detected current. The current-representative voltage is applied to a summing circuit which receives also a reference voltage set in a reference voltage circuit. The summing circuit develops a signal representative of the difference between the current representative voltage and the reference voltage, and the signal is applied through an error amplifier to a control circuit. The control circuit operates to control the high-frequency inverter so as to make the current representative voltage equal to the reference voltage. In other words, this power supply apparatus is constant current controlled.

Another type of power supply apparatuses for lamps is constant-power controlled, in which power supplied to a load or lamp is detected, and a high-frequency inverter is so controlled as to make the detected power to the load become equal to a predetermined value.

Prior art constant-current controlled power supply apparatuses cannot provide constant power to a lamp, and, therefore, the brightness of the lamp fluctuates. With this type of power supply apparatus, when input current decreases, the output power supplied to the load also decreases, resulting in insufficient current to the lamp, which, in turn, may cause the lamp to be turned off.

As for the above-described constant-power controlled power supply apparatus, even when an input voltage decreases, constant-power controlling is continued. This means that when an input voltage decreases below a rated voltage, input current increases. If the input current increases above allowable current values of an electric outlet and lines to which the input-side rectifier circuit is connected, the outlet and lines may be broken.

An object of the present invention is to provide a power supply apparatus for light sources, which can power the light sources in such a manner that the light sources can provide constant brightness, does not cause interruption of the operation of the light sources even when input current decreases, or does not cause an outlet, a connector and wires to be broken.

SUMMARY OF THE INVENTION

According to the present invention, a power supply apparatus for a light source includes an AC-to-DC converter for converting an input AC signal into a DC signal. A DC-to-high-frequency converter converts the DC signal to a high-frequency signal. Output providing means converts the high-frequency signal to an output signal for the light source, either in the form of DC output signal or AC output signal, which is to be applied to the light source. A high-frequency-to-DC converter or a high-frequency-to-AC converter may be used as the output providing means. Power detecting means detects the power which is supplied to the light source through the application of the DC output signal or AC output signal thereto, and develops a power-representative signal. Control means controls the DC-to-high-frequency converter in such a manner that the power supplied to the light source can have a predetermined value, in accordance with the power representative signal. Input current detecting means detects a current value of the AC input signal and develops an input current representative signal. If the input current representative signal value is below a predetermined input current reference value, input current control means provides such a control signal to the DC-to-high-frequency converter control means as to maintain the AC input signal current at a predetermined value.

The power supply apparatus for light sources described above is constant power controlled by detecting the power being supplied to the light source and controlling the DC-to-high-frequency converter in such a manner that the detected power can be at a predetermined value. Accordingly, if the input voltage at the rated value is being applied to the apparatus, the power supplied to the light source and, hence, the brightness of the light source can be constant. If the input voltage decreases below the rated value when the apparatus is being constant power controlled, the input current will increase. In such a case, if a source of the AC input signal is provided with a breaker, the breaker will be tripped and the light source will be turned off. According to the invention, in order to prevent such tripping, the power supply apparatus is subjected to constant current controlled instead of being constant power controlled if the input voltage decreases, so that the light source can continue to emit light.

The DC-to-high-frequency converter control means may include first error amplifying means which provides a first error signal representative of the difference of the power-representative signal from a predetermined constant-power reference value. In this case, the input current control means includes second error amplifying means which provides the first error amplifying means with a second error signal representative of the difference of the input current representative signal from the input current reference value. For example, the first error amplifying means may be so configured as to output, as the first error signal, a signal representing the difference between the sum of the second error signal and the power-representative signal and the constant-power reference signal.

The DC-to-high-frequency converter may be controlled in such a manner that the input current can assume a predetermined value when the input voltage becomes lower than a predetermined value. However, in order to realize it, a complicated arrangement will be required, which includes an input voltage detector, a comparator for judging whether the detected input voltage is lower than a predetermined value, an input current detector, an error amplifier developing an error signal representing the difference between the input current and a predetermined reference current value, and a switching arrangement causing the error signal from the error amplifier to be coupled to the control means so that it can operate in accordance with the error signal. In contrast, with the above-described arrangement according to the present invention, when the value of the input current is larger than the input current reference value, the second error signal gives little effect on the first error signal, which permits constant power control to be performed, and, if the input current value becomes smaller than the input current reference value, the second error signal gives effect on the first error signal so that the power supply apparatus can be constant current controlled to make the input current constant. As is understood, the circuit arrangement can be simpler than the above-described input voltage detecting arrangement.

A power factor improving circuit may be disposed between the AC-to-DC converter and the DC-to-high-frequency converter. With such arrangement, the phase difference between the voltage and current of a signal applied to the DC-to-high-frequency converter is reduced so that the power factor is improved. Thus, the DC signal can be converted to the high-frequency signal at a high efficiency.

A low-frequency transformer may be disposed between the AC-to-DC converter and the DC-to-high-frequency converter. With this arrangement, harmonic noise generated when the AC input signal is converted to the DC signal in the AC-to-DC converter can be removed.

DESCRIPTION OF EMBODIMENTS

Figure 1:
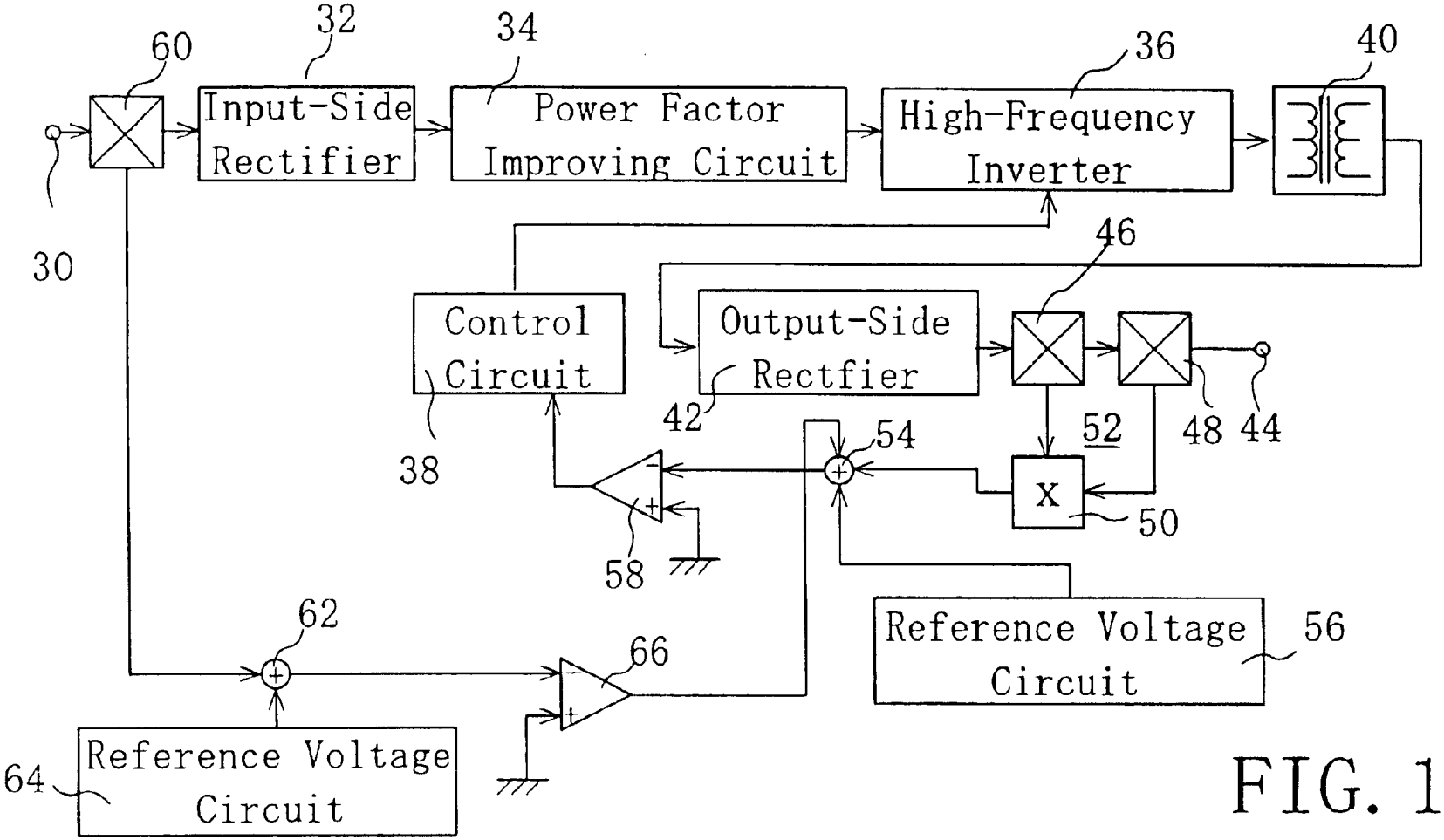
FIG. 1 is a block circuit diagram of a power supply apparatus for light sources according to a first embodiment of the present invention.

FIG. 1 shows a power supply apparatus for light sources according to a first embodiment of the present invention. The power supply apparatus includes a power supply terminal 30 which is adapted to be connected to a commercial AC power supply. Although only one terminal 30 is shown, two power supply terminals are provided when a single-phase commercial AC power supply is used, and three power supply terminals are provided for a three-phase commercial AC power supply.

A commercial AC signal supplied from the commercial AC power supply to the power supply terminal 30 is coupled to an AC-to-DC converter and is rectified. The AC-to-DC converter may be, for example, an input-side rectifier 32 including rectifying diodes. The output of the input-side rectifier 32 is applied to a power factor improving circuit 34. The configuration of the power factor improving circuit 34 is known, and, therefore, its detailed description is not given. The power factor improving circuit 34 operates to make the phases of the voltage and current of the output signal of the input-side rectifier 32 coincide with each other.

The output signal of the power factor improving circuit 34 is applied to a DC-to-high-frequency converter, e.g. a high-frequency inverter 36. The high-frequency inverter 36 includes a plurality of semiconductor switching devices, e.g. IGBTs, power FETs or bipolar transistors. The semiconductor switching devices are repetitively turned on and off at a high rate in response to a control signal applied thereto from a control circuit 38, to thereby convert the output signal of the power factor improving circuit 34 to a high-frequency signal. The high-frequency signal is then applied to a transformer 40, where it is lowered to a predetermined value.

The high-frequency signal from the transformer 40 is applied to output signal providing means, e.g. an output-side rectifier 42, where it is converted to a DC signal. The DC signal is applied via an output terminal 44 to a load (not shown), e.g. a light source. The light source may be a lamp. In FIG. 1, only one output terminal 44 is shown, but, actually, two output terminals 44 are provided.

A load voltage detector 46 is connected across the lamp, and develops a load voltage representative signal, e.g. load voltage representative voltage, representing the load voltage applied to the lamp. A load current detector 48 is connected in series with the lamp, and develops a load current representative signal, e.g. load current representative voltage, representing current supplied to the lamp. The load voltage representative voltage and the load current representative voltage are multiplied by a multiplier 50, and a load power representative signal, e.g. a load power representative voltage, representing power supplied to the lamp is developed. The load voltage detector 46, the load current detector 48 and the multiplier 50 form load power detecting means 52.

The load power representative voltage is applied to combining means. The combining means may be a summer 54. The summer 54 receives also a constant-power reference signal, e.g. a constant-power reference voltage, representing a predetermined value of power for a rated voltage condition, from a reference signal source, e.g. a reference voltage circuit 56. The summer 54 develops an output signal, e.g. an output voltage, representing the difference between the load power representative voltage and the constant-power reference voltage. The output voltage has a value equal to the load power representative voltage from the multiplier 50 minus the constant-power reference voltage, and is applied to a minus (−) input terminal of an error amplifier 58. The error amplifier 58 has a plus (+) input terminal which is coupled to a reference potential point or ground. Thus, the output signal, e.g. the output voltage, of the error amplifier 58 is a sign-inverted version of the output voltage of the summer 54. The error amplifier 58 and the summer 54 form first error amplifying means.

The output voltage of the error amplifier 58 is applied to a control circuit 38, which controls the conduction periods of the semiconductor switching devices of the high-frequency inverter 36 in such a manner as to make the output voltage of the error amplifier 58 zero, or, in other words, to make the load power representative voltage from the multiplier 50 equal to the constant-power reference voltage provided by the reference voltage circuit 56. In other words, the control circuit 38 provides constant power control. The first error amplifying means and the control circuit 38 form control means.

Figure 2A:
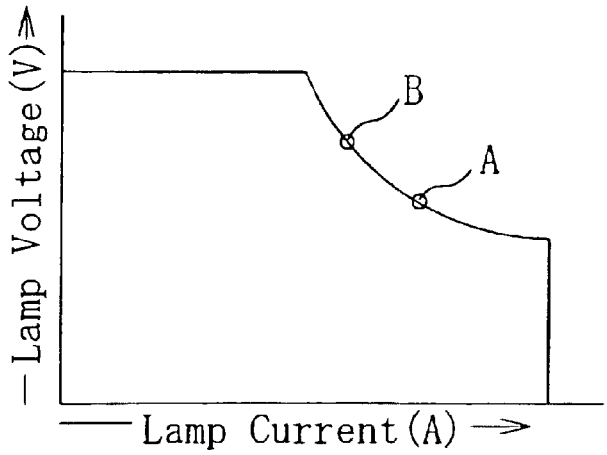
FIGS. 2A, 2B and 2C show some characteristics for use in explaining an operation of the power supply apparatus of FIG. 1.

Let it be assumed that a lamp (load) current and a lamp (load) voltage at a point A on the characteristic curve of FIG. 2A are supplied under constant power control. If the lamp current decreases, the lamp voltage increases in order to maintain the load power constant, as shown at a point B. On the other hand, if the lamp current at the point B increases, the lamp voltage at the point B decreases to maintain the lamp power constant. Like this, the power supplied to the lamp is maintained constant, and, therefore, the brightness of the lamp can be maintained constant regardless of fluctuations in load current and load voltage.

Figure 2B:
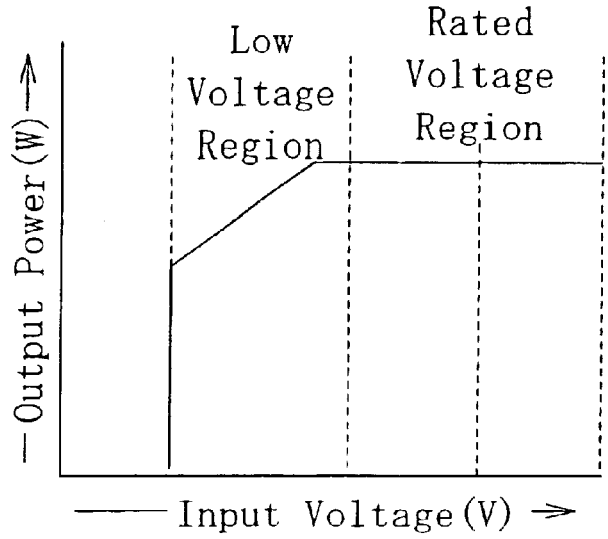

The constant power control described above can be provided whenever the input voltage to the power supply apparatus is within a rated voltage range (FIG. 2B). If the input voltage decreases to a value in a low voltage region which is below the rated voltage range, the input current tends to increase with decrease of the input voltage, trying to maintain the constant power control. The rated current value of home-use electric outlets is 15 A, and, therefore, it is not permitted that current larger than 15 A flows through such outlets. When the power supply apparatus is constant power controlled at power of 1,500 W, with the input voltage of 100 V applied thereto, the input current is 15 A. If the input voltage decreases to 80 V, for example, the input current would be 18.75 A (=1500 W/80 V), which is larger than the rated current value and may damage or break the outlets and wires. If the power supply apparatus is provided with a fuse, it will melt away. If a breaker is provided, it will be tripped.

To deal with such situations, according to the present invention, an input-side current detector 60 is connected between the power supply terminal 30 and the input-side rectifier 32. The input-side current detector 60 detects the input current and develops an input current representative signal, e.g. an input current representative voltage. The input current representative voltage is applied to another combining means, which may be a summer 62. The summer 62 receives also an input current reference signal, which may be in the form of voltage, from an input current reference signal source, which may be an input current reference voltage circuit 64. The input current reference voltage is set to a value corresponding to such an input current that cannot damage the power supply apparatus, but can energize the lamp to emit light. The summer 62 develops an output voltage corresponding to the difference between the input current representative voltage and the input current reference voltage, e.g. the input current representative voltage minus the input current reference voltage. The output voltage of the summer 62 is coupled to a minus (−) input terminal of an error amplifier 66. The error amplifier 66 receives at its plus (+) terminal a reference potential, e.g. ground potential. The error amplifier 66 provides, as its output, a phase-inverted version of the output voltage of the summer 62.

The output voltage of the error amplifier 66 is coupled to the summer 54. Then, the summer 54 develops an output voltage having a value which is equal to the sum of the output voltage of the error amplifier 66 and the power representative voltage from the multiplier 50, minus the constant-power reference voltage from the reference voltage source 56. The error amplifier 66, the summer 62 and the input current reference voltage circuit 64 form second error amplifying means as well as input current control means.

In the constant power control mode in the rated voltage range, the input current representative voltage is approximately equal to the input current reference voltage, so that the output voltage of the summer 62 is approximately zero and, therefore, does not give a large influence on the control of the high-frequency inverter 36.

Figure 2C:
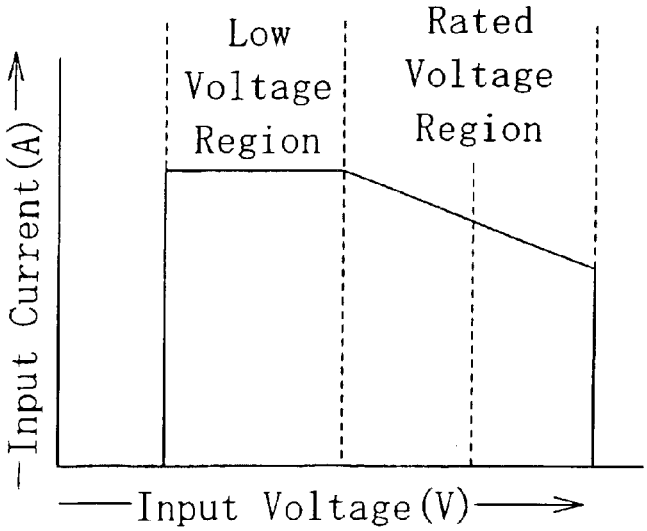

In the low voltage region, the input current representative voltage is larger than the input current reference voltage, so that the output voltage of the summer 62 rises. In this low voltage region, the power representative voltage from the multiplier 50 decreases. Accordingly, the output voltage of the summer 62, which is larger, gives a substantially larger influence on the output of the error amplifier 58. Then, the control circuit 38 operates to control the high-frequency inverter 36 to make the output voltage of the error amplifier 58 zero, or, in other words, to make the input current maintain a predetermined value in the low voltage region as shown in FIG. 2C. Thus, since the input current is maintained constant, the lamp can continue emit light, although the input voltage has been decreased and, therefore, the power supplied to the lamp has been decreased.

If the constant power control were continued even when the input voltage is in the low voltage region, the power supply apparatus would tend to supply a large lamp current, but it cannot be supplied, so that the lamp could not continue to emit light any more. However, according to the present invention, the constant power control is interrupted in the low voltage region, and, therefore, the lamp can continue to emit light.

If the input voltage decreases further, the circuit operation will be discontinued in order to protect the entire circuit.

Figure 3:
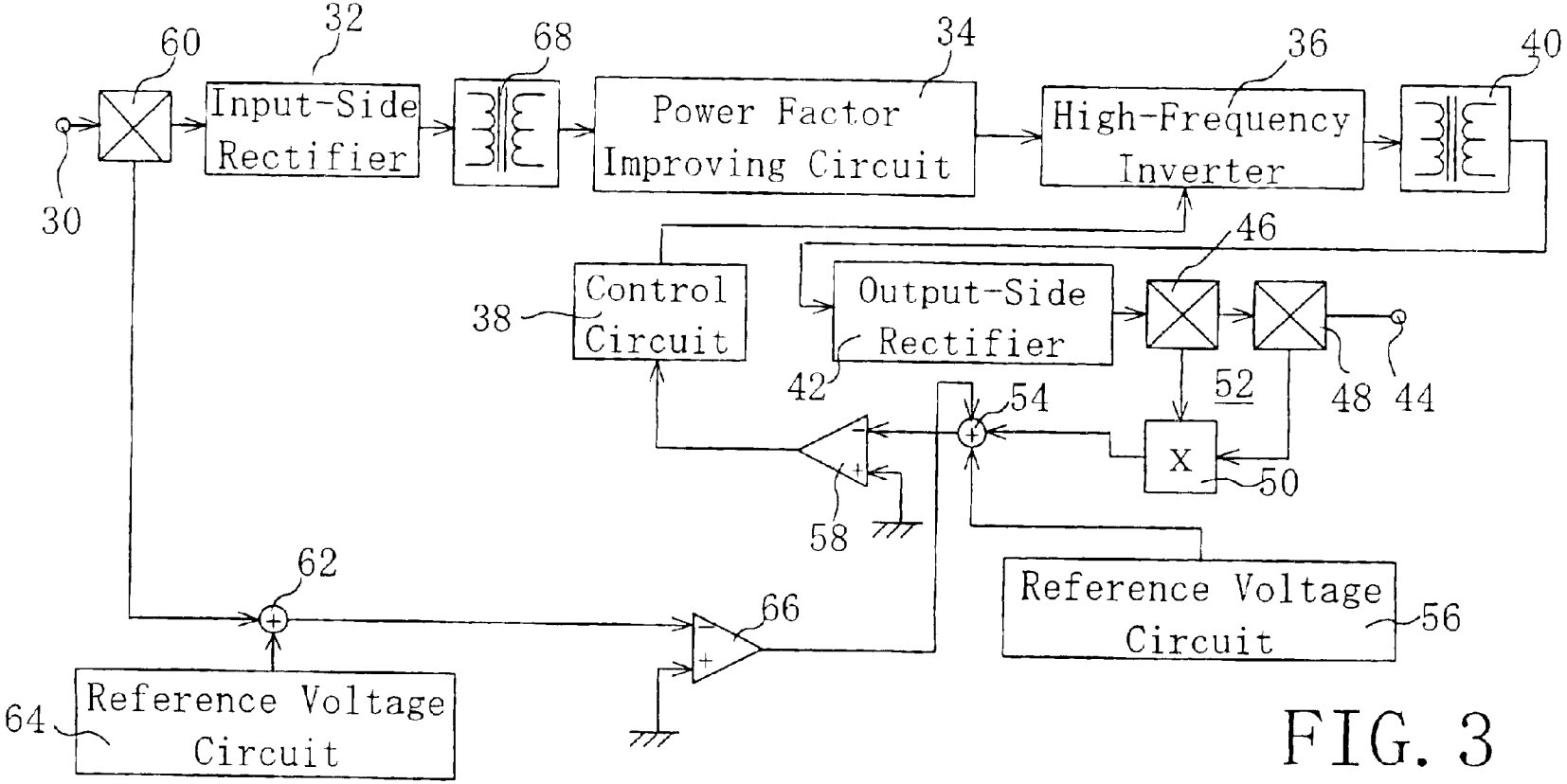
FIG. 3 is a block circuit diagram of a power supply apparatus for light sources according to a second embodiment of the present invention.

According to a second embodiment of the present invention, the power factor improving circuit 34 employed in the power supply apparatus shown in FIG. 1 is eliminated, and a low-frequency transformer 68 is connected in place of the power factor improving circuit 34, as shown in FIG. 3. The use of the low-frequency transformer 68 is equivalent to the use of a passive filter in the output of the input-side rectifier 32, which operates to remove harmonics generated by the input-side rectifier 32. In the circuit shown in FIG. 3, the same reference numerals and symbols as used in FIG. 1 denote the same or similar components or functions as explained with reference to FIG. 1, and, therefore, description about them is eliminated.

Figure 4:
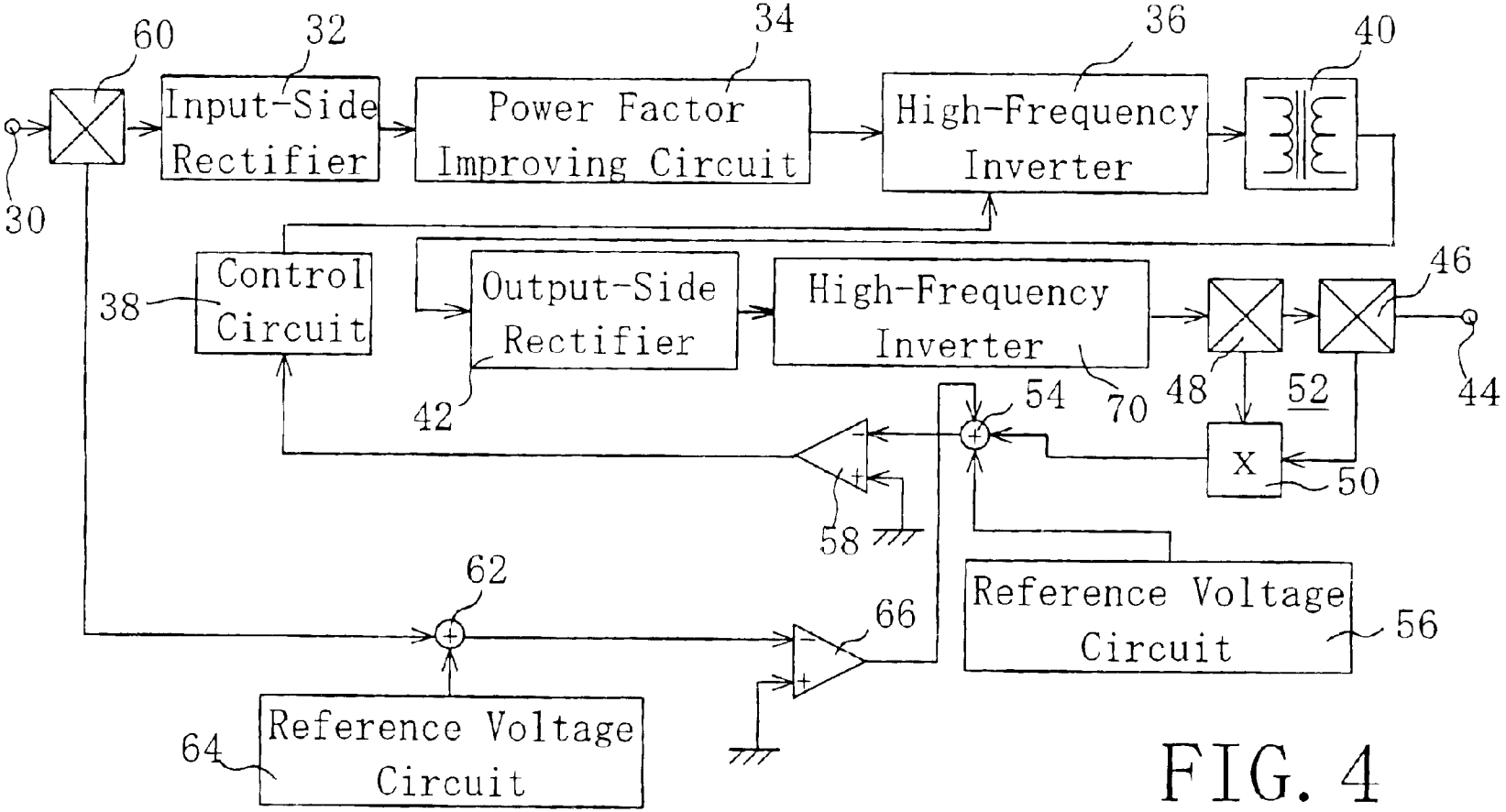
FIG. 4 a block circuit diagram of a power supply apparatus for light sources according to a third embodiment of the present invention.

FIG. 4 is a block circuit diagram of a power supply apparatus according to a third embodiment of the present invention. The same reference numerals and symbols as used in FIG. 1 denote the same or similar components or functions as explained with reference to FIG. 1, and, therefore, description about them is not given. According to the third embodiment, a high-frequency-to-AC converter formed of, for example, the output-side rectifier 42 and an inverter 70, is connected in a stage succeeding the transformer 40. With this arrangement, the light source or lamp is AC driven. In place of the output-side rectifier 42 and the inverter 70, a cycloconverter, which converts a high-frequency signal directly to an AC signal, can be used.

Although the power supply apparatuses have been described to use the high-frequency inverter 36 as the DC-to-high-frequency converter, a chopper circuit may be used instead. Also, in place of the power detecting means including the load voltage detector 46, the load current detector 48 and the multiplier 50 used in the described embodiments, a power detector which can directly detect power may be used.

What is claimed is:

1. A power supply apparatus for a light source, comprising:

an AC-to-DC converter for converting an input AC signal from an AC power supply to a DC signal;

a DC-to-high-frequency converter for converting said DC signal to a high-frequency signal;

power supplying means for supplying, to said light source, power based on said high-frequency signal;

power detecting means for detecting power supplied to said light source, from said power supplying means and developing a power representative signal representing the detected power;

control means for controlling said DC-to-high-frequency converter in accordance with said power representative signal in such a manner as to cause the power supplied to said light source to have a predetermined value;

input current detecting means for detecting a value of current of said input AC signal supplied from said AC power supply to said AC-to-DC converter, and developing an input current representative signal representing the detected current; and input current control means for providing such a control signal to said DC-to-high-frequency converter control means as to maintain the current of said input AC signal at a predetermined value when said input current representative signal is smaller than a predetermined input current reference value.

2. The power supply apparatus according to claim 1 wherein:

said DC-to-high-frequency converter control means includes first error amplifying means developing a first error signal representing a difference between said power representative signal and a predetermined constant-power reference value; and said input current control means includes second error amplifying means applying a second error signal representing a difference between said input current representative signal and said input current reference value to said first error amplifying means in such a manner as to influence said first error signal.

3. The power supply apparatus according to claim 1 wherein a power factor improving circuit is disposed between said AC-to-DC converter and said DC-to-high-frequency converter.

4. The power supply apparatus according to claim 2 wherein a power factor improving circuit is disposed between said AC-to-DC converter and said DC-to-high-frequency converter.

5. The power supply apparatus according to claim 1 wherein a low-frequency transformer is disposed between said AC-to-DC converter and said DC-to-high-frequency converter.

6. The power supply apparatus according to claim 2 wherein a low-frequency transformer is disposed between said AC-to-DC converter and said DC-to-high-frequency converter.

* * * * *